United States Patent [19]

Richardson et al.

[11] 4,015,717

[45] Apr. 5, 1977

[54] TABLET PACKAGE FOR USE IN CHRONOLOGICALLY DISPENSING TABLETS

[75] Inventors: James E. Richardson, Weston; Stephen C. Swain, Westport, both of Conn.

[73] Assignee: The Medical Dispenser Company, Atlantic Highlands, N.J.

[22] Filed: Aug. 25, 1975

[21] Appl. No.: 607,581

Related U.S. Application Data

[63] Continuation-in-part of Ser. No. 455,979, March 29, 1974, Pat. No. 3,904,075.

[52] U.S. Cl. ..... 206/534; 206/531; 221/5

[51] Int. Cl.[2] ..... B65D 85/56

[58] Field of Search ..... 206/534, 539, 531; 221/86, 88, 5; 116/121

[56] References Cited

UNITED STATES PATENTS

| | | | |
|---|---|---|---|
| 3,279,651 | 10/1966 | Thompson | 221/88 |
| 3,397,671 | 8/1968 | Hartman | 116/121 |
| 3,437,236 | 4/1969 | Huck | 221/86 |
| 3,651,927 | 3/1972 | Richardson | 206/534 |

*Primary Examiner*—Ro E. Hart
*Attorney, Agent, or Firm*—Robert H. Epstein

[57] ABSTRACT

A tablet package for use in chronologically dispensing tablets includes a sheet of material having pockets therein for receiving tablets, a frangible closure layer secured to the sheet of material to enclose the tablets and a plurality of time related indicia disposed on the closure layer associated with each tablet and aligned with the pockets such that dispensing of a tablet ruptures the closure layer to obliterate the indicia associated with that tablet. The tablet package is particularly useful with a tablet dispenser formed of a housing including a body having a dispensing opening therein and a cover pivotally connected with the body and carrying an ejector tab aligned with the dispensing opening, the tablet package being disposed in the body. A tablet to be dispensed is moved between the ejector tab and the dispensing opening; and, in order to dispense the tablet, a user need only squeeze the housing to move the body and cover relative to each other such that the ejector tab engages the tablet to rupture the frangible closure layer and permit the tablet to drop through the dispensing opening.

12 Claims, 10 Drawing Figures

TABLET PACKAGE FOR USE IN CHRONOLOGICALLY DISPENSING TABLETS

REFERENCE TO RELATED APPLICATION

This application is a continuation-in-part of pending application Ser. No. 455,979 filed Mar. 29, 1974 now U.S. Pat. No. 3,904,075.

BACKGROUND OF THE INVENTION

1. Field of the Invention

The present invention pertains to the dispensing of tablets and, more particularly, to a tablet dispenser facilitating sequential dispensing of pharmaceutical tablets.

2. Discussion of the Prior Art

There have been many attempts in the prior art to provide tablet dispensers facilitating the sequential dispensing of pharmaceutical tablets in chronological order, as exemplified by U.S. Pat. Nos. 3,437,236, 3,450,252, 3,533,371, 3,557,747, 3,570,707 and 3,572,282. Such tablet dispensers are primarily utilized to dispense birth control or oral contraceptive preparations in that such preparations are required to be taken on a daily regimen. The prior art tablet dispensers, as exemplified above, have suffered from one or more of the disadvantages of utilizing a relatively large number of intricately formed parts, therefore, increasing cost of manufacture, requiring cumbersome manipulation of tablets by the user in order to fill the dispensers, and having complex indicia viewing structure to permit the user to determine whether there has been any variation from the daily regimen.

In order to facilitate placement and refilling of tablets in dispensers, it has been proposed to utilize tablet packages in the form of "blister packs" wherein the tablets are supported by a frangible material, such as aluminum foil. U.S. Pat. No. 3,279,651 is exemplary of a tablet dispenser utilizing a tablet "blister pack", the tablets each being dispensed through a corresponding opening in the housing of the dispenser by relative rotation of parts of the housing. The rotation required for dispensing increases the cost of manufacture of the tablet dispenser and presents a problem with respect to the displaying of indicia to a user to indicate a daily regimen. In the tablet dispenser of U.S. Pat. No. 3,651,927, tablet packages in the form of "blister packs" are used, and tablets are dispensed by pressure applied by the finger of a user to force the tablets through annularly arranged apertures in the dispenser housing. The tablet dispenser of this patent, thus, does not require rotation for dispensing; however, the housing must be opened in order to dispense a tablet. Accordingly, while the prior art has recognized the advantages of the use of tablet blister packs, the prior art tablet dispensers for use therewith have not provided simplified dispensing and inexpensive manufacture.

SUMMARY OF THE INVENTION

The present invention is generally summarized in a tablet package for use in chronologically dispensing tablets including a sheet of material having a plurality of pockets formed therein, a plurality of tablets each disposed in one of the pockets in the sheet of material, a frangible closure layer secured to the sheet of material to enclose the tablets, and a plurality of time-related indicia disposed on the closure layer associated with each of the tablets and aligned with the pockets in the sheet material whereby dispensing of the tablets from the tablet package ruptures the closure layer to obliterate the time-related indicia associated therewith.

Accordingly, it is a primary object of the present invention to provide a tablet dispenser overcoming the disadvantages of the prior art which is utilized with refillable tablet packages, preferably of the blister pack type, and has simplified housing structure.

Another object of the present invention is to permit dispensing of tablets by merely squeezing parts of a housing to rupture or tear a frangible material at least partially enclosing a tablet therein to permit the tablet to drop from the housing.

A further object of the present invention is to permit observation of time related indicia associated with each tablet in a tablet package and dispensing of the tablets through the same opening in a housing of a tablet dispenser such that a user can easily determine which tablets have been dispensed in accordance with a time related regimen.

The present invention has an additional object in the dispensing of a tablet from a tablet dispenser by utilizing a tab carried on a cover pivotally connected with a body to engage tablets disposed in the body and rupture a frangible material at least partially enclosing the same such that the force required for ejection of a tablet is reduced and the tablets can be dispensed without requiring direct pressure on the tablets from a finger of a user or inverting of the tablet dispenser.

Yet another object of the present invention is to utilize a single opening in a tablet dispenser to permit dispensing of tablets from a tablet package wherein the tablets are at least partially enclosed by a frangible material, the tablet package being rotatable within the housing of the tablet dispenser with clearance provided for torn or ruptured portions of the frangible material.

Yet a further object of the present invention is to provide a tablet package for use in chronologically dispensing tablets wherein time-related indicia associated with each tablet are disposed on a frangible closure layer enclosing the tablets in pockets in a blister sheet such that dispensing of the tablets ruptures the closure layer and obliterates the indicia.

Some of the advantages of the present invention over the prior art are that the number of components required for the tablet dispenser is reduced to a minimum, initial placement and refilling of tablets in the housing of the tablet dispenser is facilitated, dispensing of a tablet requires only a single squeezing movement between the cover and the body of the housing, and no opening, rotation or inverting of the tablet dispenser is required for dispensing of a tablet therefrom.

Other objects and advantages of the present invention will become apparent from the following description of the preferred embodiment taken in conjunction with the accompanying drawings.

DESCRIPTION OF THE PREFERRED EMBODIMENT

Figure 1:
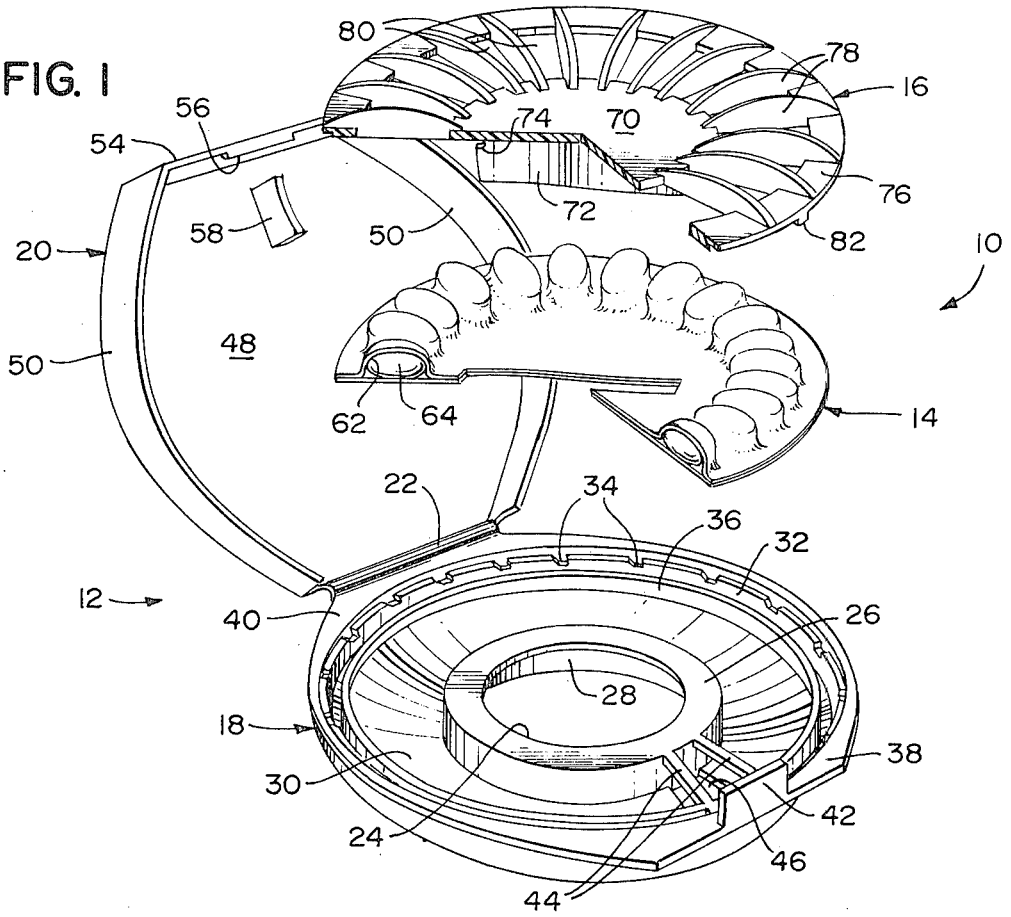
FIG. 1 is a broken exploded perspective view of the tablet dispenser of the present invention.

A tablet dispenser 10 according to the present invention is illustrated in FIG. 1 and includes, as basic components, a housing 12 and a tablet package 14 received in the housing. As will be discussed in greater detail hereinafter, the housing 12 is designed to be refillable such that, once all of the tablets from the package 14 have been dispensed, a new package of tablets can be used with a separate indexing disc 16 or can be integrally formed with an indexing structure.

The housing 12 includes a round body 18 and a round cover 20 pivotally connected with the body by a hinge 22. The body 18, cover 20 and hinge 22 are preferably integrally formed of a plastic material as a single piece such that the hinge 22 biases the cover away from the body; however, the housing 12 can be formed of any suitable material in as many parts as desired, and a separate hinge and bias means can be used to join the cover with the body.

Body 18 has a central aperture 24 therein defined by the edge of a flange 26 extending inwardly from an annular wall 28 upstanding from a concave bottom wall 30 of the body. The concave configuration of the bottom wall 30 forms a recess in the body 18 defined at its periphery by an annular wall 32 having notches 34 in the upper edge thereof, and an annular support wall 36 extends from bottom wall 30 inwardly spaced from peripheral wall 32 and arranged concentrically with walls 28 and 32. Ledges 38 and 40 extend transversely from the axis of the body in the front and rear thereof, respectively, with the front ledge 38 terminating at a straight edge from which a stop 42 extends while the rear ledge 40 terminates at hinge 22. A pair of radially extending members 44 span the recess in the body 18 between flange 26 and support wall 36 in alignment with the stop 42, and a dispensing opening 46 is formed in bottom wall 30 under members 44 and diametrically opposite the hinge 22.

The cover has a configuration mating with the configuration of body 18 and is formed of a top wall 48 having curved walls 50 depending from the side edges thereof, a flat wall 52 depending from the rear edge thereof and terminating at hinge 22 and flat wall 54 depending from the front edge thereof and terminating at an inwardly turned, locking lip 56. An ejector tab 58 which is concave shaped to generally conform to the tablet protrudes inwardly from top wall 48 adjacent frontwall 54 for alignment with dispensing opening 46 when the cover 20 is closed. The concave shape helps prevent breaking of the tablet when it is dispensed. The walls depending from top wall 48 have a length to extend below the ledges around the body 18 when the cover is closed, and the length of stop 42 is less than the length of front wall 54 such that the cover 20 is movable relative to the body 18.

Figure 5:
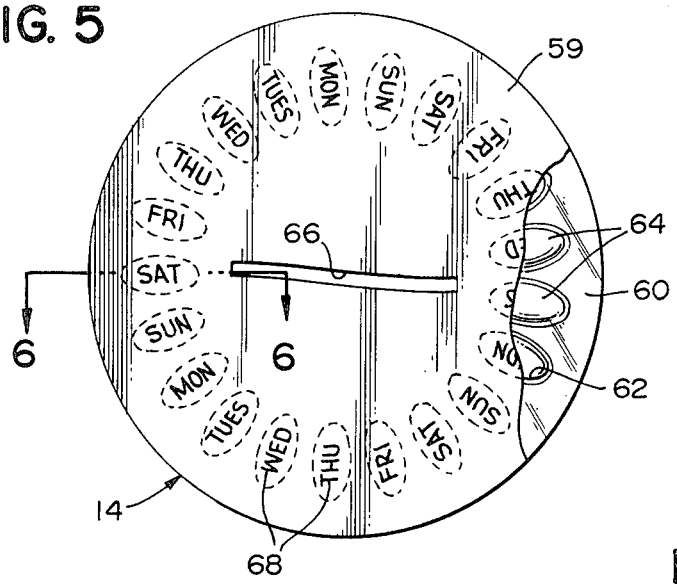
FIG. 5 is a broken bottom plan view of the tablet package of the present invention.
Figure 6:
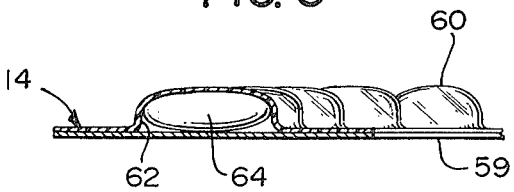
FIG. 6 is a sectional view of the tablet package taken along line 6-6 of FIG. 5.

The tablet package 14 has a disc-like configuration and is formed of a planar closure layer 59 made of a frangible material, such as thin aluminum foil, and a thermo or vacuum formed blister sheet 60 made of a transparent plastic material defining a plurality of annularly arranged pockets 62 each receiving a tablet 64 to be dispensed, as shown in FIGS. 5 and 6. The tablet package 14 can be manufactured in accordance with conventional "blister" packaging techniques with the closure layer 59 sealed to the blister sheet 60 after loading of the tablets 64 in the pockets 62, the tablets being preferably vertically positioned on edge in the pockets in order to minimize the diameter of the tablet dispenser 10. A slightly curved slot 66 is formed through the closure layer 59 and the blister sheet 60 in the center of the tablet package 14 so as to be aligned with the central aperture 24 when the tablet package is positioned in body 18. Time related indicia 68, sequentially indicating the days of the week or the particular regimen of use for the product being dispensed, are carried on closure layer 59 in alignment with pockets 62 such that each tablet in the package has associated therewith a specific day of the week or use period in chronological order.

Figure 5A:
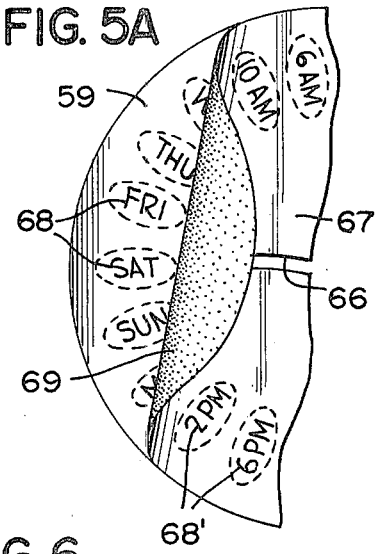
FIG. 5*a* is a broken bottom plan view of a modification of the tablet package of the present invention.

The time related indicia 68 can be printed directly on the closure layer 59 as shown in FIGS. 5 and 6 or the time related indicia 68' can be printed on a cover sheet or label 67 made of very thin frangible material, such as paper, having the same dimensions and configuration as closure layer 59 including the slightly curved slot 66, as shown in FIG. 5*a*. The cover sheet 67 carries a pressure sensitive adhesive 69 such that the cover sheet can be secured to the closure layer, the adhesive 69 being covered by release paper prior to application of the cover sheet. In this manner, the time related indicia 68' representative of a particular regimen of use can be secured to the package by a pharmacist or other person dispensing the tablets; and, thus, the tablet packages can be used for different prescribed regimens by merely securing a cover sheet 67 having time related indicia thereon corresponding to the prescribed regimen to the closure layer 59. Preferably, the closure layer of each tablet package will carry time related indicia corresponding to a standard regimen, such as days of the week; and, should the standard regimen need to be changed to a different prescribed regimen, a cover sheet 67 carrying time related indicia 68' corresponding to the prescribed regimen need only be secured to the closure layer to cover the time related indicia 68 thereon and display the time related indicia 68'.

Figure 7:
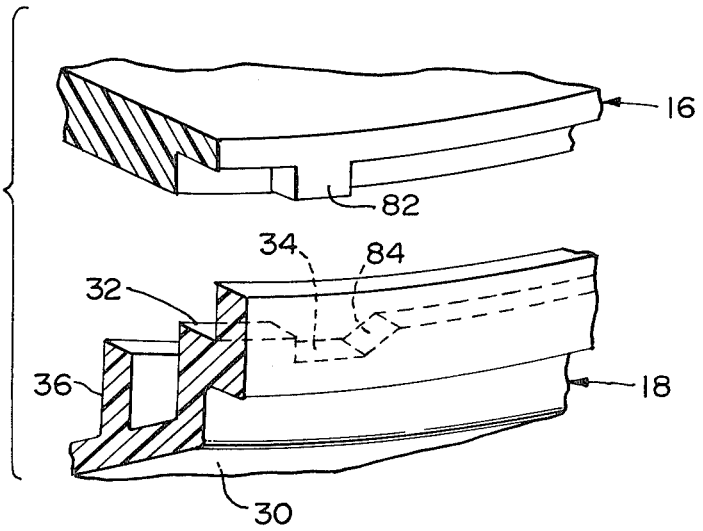
FIG. 7 is a broken exploded perspective view of the indexing discu and housing of the tablet dispenser of FIG. 1.

The indexing disc 16 has a central hub 70 with a tab 72 extending therefrom undercut at both ends at 74, and an outer ring 76 is spaced from hub 70 with a plurality of radical ribs 78 extending therebetween to define annularly arranged openings 80 in the indexing disc 16. The openings 80 are arranged to receive the pockets 62 of the tablet package 14, there being, (in the case of an oral contraceptive) twenty-one tablets 64 and openings 80 to the tablets. A pair of diametrically opposed detent lugs 82 depend from the bottom surface of outer ring 76 and, as best shown in FIG. 7, cooperate with detent notches 34 to index rotational movement of the tablet package 14 and permit movement only in a predetermined direction by riding up inclined surfaces 84 of the detent notches, the predetermined direction of rotation being clockwise looking down on the tablet dispenser as shown in FIG. 1 and counterclockwise looking at FIG. 2.

In use, the tablet package 14 is assembled with the indexing disc 16 with the pockets 62 extending through the openings 80 in the indexing disc and the tab 72 extending through the slot 66 in the tablet package. The assembled tablet package and indexing disc are then disposed in the recess in the body 18 of the housing 12 with the tablet package supported by flange 26 and support wall 36 and the rim of the indexing disc engaging peripheral wall 32, it being noted that the tablets 64 are arranged to be aligned with the dispensing opening 46 in the body as the tablet package is rotated. The detent notches 34 are aligned with the dispensing opening 46 such that with the detent lugs 82 engaging the detent notches 34, a pocket 62 will always be disposed directly above the dispensing opening 46. The indexing disc 16 is preferably made of a deformable material, such as plastic; and, the tab 72 has inwardly sloping edges extending from undercuts 74, where the length of the tab is greater than the diameter of central aperture 24 in the body 18, to the end where the length of the tab is less than the diameter of the central aperture 24 such that the tab can be easily inserted in the central aperture 24 and deformed such that the edge of the flange 26 will be received in the undercuts 74. With the tablet package and the indexing disc positioned in the body 18, the cover 20 is closed such that the locking lip 56 engages the bottom edge of the ledge 38 to maintain the cover in the closed position.

Figure 2:
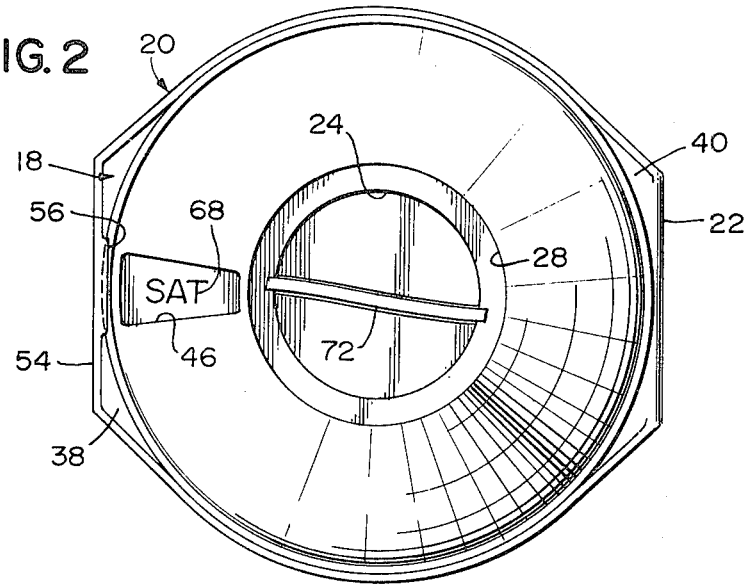
FIG. 2 is a bottom plan view of the tablet dispenser of FIG. 1.
Figure 3:
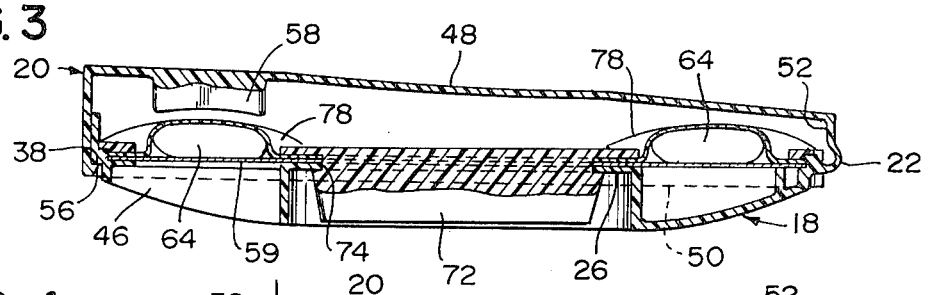
FIGS. 3 and 4 are cross sectional views of the tablet dispenser of FIG. 1 in storage and dispensing states, respectively.

With the housing 12 closed, the tablet dispenser 10 will be in the storage state, as shown in FIG. 3, with the hinge 22 biasing the cover away from the body to a position limited by the abutment of lip 56 with ledge 38. The ejector tab 58 will, thus, be spaced from the dispensing opening 46 with the tablets 64 being movable in the space therebetween for dispensing. To use the dispenser, the tablets are rotated clockwise within the housing by turning tab 72 until the indicia 68 or 68′ corresponding to the time of first usage is visible through the dispensing opening. For instance, as shown in FIG. 2, the tab 72 would be turned until indicia 68 representing Saturday is visible through the dispensing opening 46. The tablet package can only be rotated clockwise due to the configuration of the detent notches 34 with the inclined surfaces 84 such that once the appropriate indicia 68 is positioned in the dispensing opening 46, the tablet package can be turned only in accordance with the chronological order of the days of the week.

Figure 4:
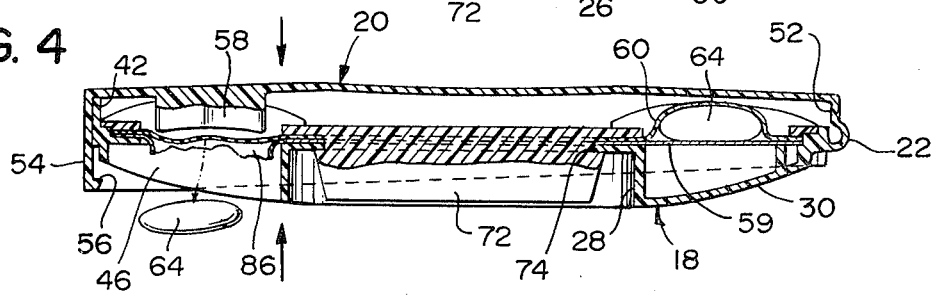

In order to dispense a tablet, the housing 12 is merely squeezed by the user such that the cover 20 is moved toward the body 18 to cause the ejector tab 58 to engage the top of the tablet 64 disposed over the dispensing opening 46 via the blister sheet 60, the force from the ejector tab rupturing the frangible material 59, as shown at 86 in FIG. 4, and the cover sheet 67 if one is used thereby permitting the tablet 64 to drop through the dispensing opening. The dispensing of the tablet 64 will, thus, obliterate the indicia 68 or 68′ associated therewith such that the user can determine at a glance whether a tablet for the time identified by the indicia has been dispensed.

Once the housing is released from the dispensing state shown in FIG. 4, the bias from hinge 22 will return the housing 12 to the storage state shown in FIG. 3 with the ejector tab 58 moving back to its position spaced from the dispensing opening to permit rotation of the tablet package to position the next tablet to be dispensed. In order to position the next tablet to be dispensed, tab 72 is turned causing the detent lugs 82 to ride up the inclined surfaces 84 of the detent notches and move along the upper edge of peripheral wall 32 to drop into the next detent notches 34, which dropping movement can be felt by the user. As well as providing proper indexing and alignment with the dispensing opening 46, the cooperation between detent lugs 82 and detent notches 34 permits the indexing disc 16 to be raised to provide clearance for movement of the ruptured or torn portions 86 of the frangible material past the members 44 aligned with the dispensing opening.

Figure 8:
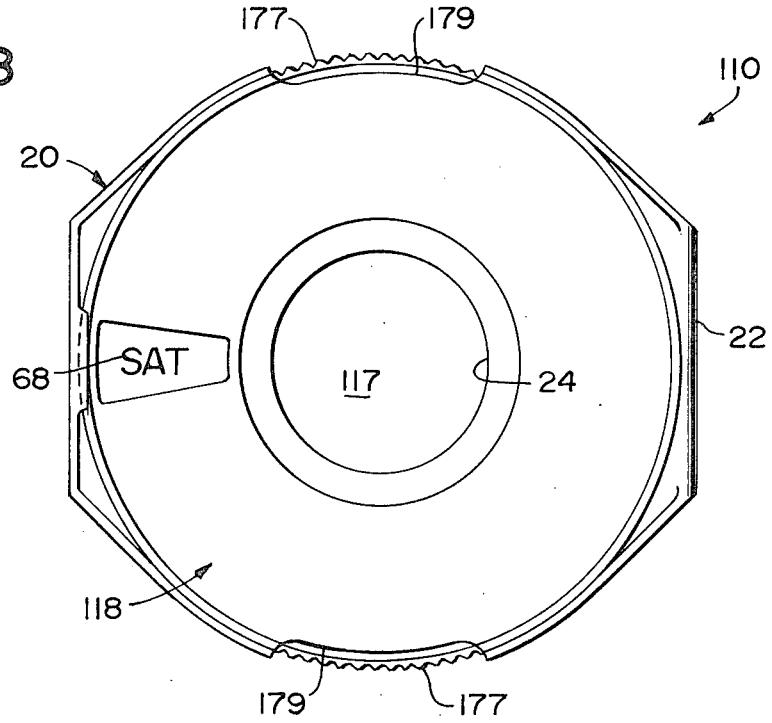
FIG. 8 is a bottom plan view of a modification of the tablet dispenser of the present invention.
Figure 9:
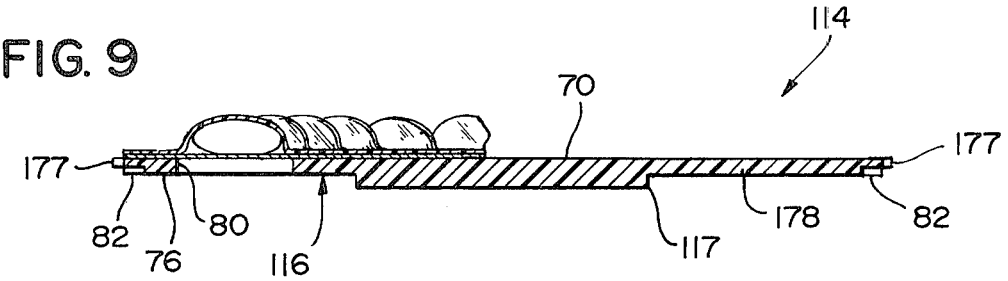
FIG. 9 is a cross sectional view of the tablet package of the tablet dispenser of FIG. 8.

A modification of the tablet dispenser of the present invention is illustrated in FIGS. 8 and 9 with parts identical to parts of the tablet dispenser 10 being given identical reference numbers and not described again and parts similar to parts of the tablet dispenser 10 given the same reference numbers with 100 added. The primary differences between the tablet dispenser 110 of FIGS. 8 and 9 and the tablet dispenser 10 are that the tablet package 114 has indexing structure formed integrally therewith and the body 118 of the housing has arcuate peripheral openings therein to expose the rim of the tablet package for rotating the tablets.

The tablet package 114 is formed of a base 116 having a planar upper surface and a cylindrical protrusion 117 extending from the bottom surface of a central hub 70, the protrusion 117 having a diameter slightly less than the diameter of the central aperture 24 in the body 118 of the housing such that with the protrusion inserted in the central aperture, tablet package 114 will be rotatable while being held in place. A plurality of ribs or spokes 178 extend from the hub 70 to an outer ring 76 defining apertures 80 therebetween. The ring 76 has a knurled peripheral rim 177, and detent lugs 82 extend from the bottom surface of ring 76. A layer of frangible material is secured to the base 116 in any suitable manner, such as by an adhesive; and, a blister sheet is sealed to the frangible material and has pockets therein receiving tablets to be dispensed, as discussed above. The "blister pack" structure of the tablet package 114 can be secured to the base 116 in any other suitable manner, as desired.

The body 118 has arcuate peripheral openings 179 on opposite sides thereof such that knurled rim 177 of the tablet package extends therethrough. If desired, the bottom wall of body 118 can close aperture 24 while the annular central wall is retained to rotatably support the tablet package 114.

The depensing operation of the tablet dispenser 110 is similar to that described above with respect to tablet dispenser 10 with the exception that the tablet package 114 is rotated to position a tablet for dispensing by gripping knurled rim 177 to rotate the base 116.

The integral construction of the tablet package as shown in FIG. 9 can be used with tablet dispenser 10 but utilizing tab 72 in place of cylindrical protrusion 117; and similarly, the separate tablet package 14 and indexing disc 16 shown in FIG. 1 can be used with the tablet dispenser 110 by providing the indexing disc with a knurled rim and a cylindrical protrusion in place of tab 72.

From the above, it will be appreciated that the structure of the present invention, as described above, permits the use of tablet packages enclosing tablets in frangible material while requiring only a single dispensing opening and obviating the retarding of movement of the tablet packages normally caused by the ruptured frangible material. Additionally, the structure of the cover and body of the housing with the ejector tab carried on the cover permits a tablet to be dispensed by merely squeezing the housing to pivot the cover and base relative to each other without requiring any further manipulation of the tablet dispenser, and the positioning of the dispensing opening of the ejector tab diametrically opposite to the hinge reduces the force required for ejection. However, while the tablet dispenser of the present invention is particularly advantageous as described above, it is noted that any type of tablet package can be utilized therewith having a frangible material at least partially enclosing the tablets, the dispensing opening can have any desired configuration and can be placed at any position in the body, and the cover could be constructed with the ejector tab pivotally attached thereto such that the ejector tab and body could be squeezed together to dispense a tablet.

The dispenser of the invention is applicable for use in connection with any tablet which is taken on a regular basis and is particularly suited to those tablets in connection with which a strict regimen of use is essential. In addition to birth control products, as particularly referred to above, many other tablets are suited for use in connection with the present invention including thyroid tablets, digitalis, antispasmodics, antidiabetes tablets, estrogens, and antibiotics. In instances where a tablet is to be taken more than once a day, the indicia printed on the tablet package or the cover sheet secured thereto would merely indicate when during any particular day that tablet was to be taken.

Inasmuch as the present invention is subject to many variations, modifications and changes in detail, it is intended that all matter described above or shown in the accompanying drawings be interpreted as illustrative and not in a limiting sense.

What is claimed is:

1. A tablet package for use in chronologically dispensing tablets comprising

- a sheet of material having a plurality of pockets formed therein;
- a plurality of tablets each disposed in one of said pockets in said sheet of material;
- a frangible closure layer secured to said sheet of material to enclose said tablets; and
- a plurality of time related indicia disposed on said closure layer associated with each of said tablets and aligned with said pockets in said sheet of material whereby dispensing of said tablets from said tablet package ruptures said closure layer to obliterate said time related indicia associated therewith.

2. A tablet package as recited in claim 1 and further comprising indexing means engaging said closure layer and having a plurality of apertures therein aligned with said pockets in said sheet of material to permit viewing of said time related indicia.

3. A tablet package as recited in claim 1 and further comprising a frangible cover sheet secured to said closure layer and carrying said plurality of time related indicia.

4. A tablet package as recited in claim 1 wherein said plurality of time related indicia correspond to a first regimen of use of said tablets and are carried on said closure layer and further comprising a frangible cover sheet secured to said closure layer to cover said time related indicia corresponding to said first regimen of use, said cover sheet carrying a plurality of time related indicia corresponding to a second regimen of use of said tablets aligned with said pockets in said sheet of material whereby dispensing of said tablets from said tablet package ruptures said cover sheet to obliterate said time related indicia corresponding to said second regimen.

5. A tablet package as recited in claim 1 wherein said tablets are positioned on edge in said pockets.

6. A tablet package as recited in claim 1 and further comprising indexing means engaging said sheet of material and having apertures therein receiving said pockets.

7. A tablet package as recited in claim 6 wherein said indexing means includes a disc having a central hub connected with an outer ring by a plurality of radial ribs defining said apertures and detent means positioned on said outer ring.

8. A tablet package as recited in claim 1 wherein said sheet of material is round and said pockets are annularly arranged on said sheet of material.

9. A tablet package as recited in claim 8 wherein said sheet of material is formed of a transparent plastic material, said closure layer is formed of a metal foil and said plastic material and said metal foil have aligned slots formed in the center thereof.

10. A tablet package as recited in claim 9 and further comprising a frangible cover sheet secured to said metal foil and carrying said plurality of time related indicia, said cover sheet having a slot therein aligned with said slot in said metal foil and said plastic material.

11. A tablet package as recited in claim 8 and further comprising a round base engaging said closure layer and having a plurality of annularly arranged apertures therein aligned with said pockets in said sheet of material to permit viewing of said time related indicia.

12. A tablet package as recited in claim 11 wherein said base has a knurled peripheral rim and detent lug means extending therefrom.

* * * * *